US006328286B1

(12) United States Patent
Sanchez et al.

(10) Patent No.: US 6,328,286 B1
(45) Date of Patent: Dec. 11, 2001

(54) APPARATUS FOR BLOWING STREAMS OF BUBBLES

(75) Inventors: Terry J. Sanchez, Vacaville, CA (US); Ron Boyle, Amelia, OH (US); Daniel Seifert, Albany, CA (US); William J. Cajka, Jr., Franklin, TN (US), by Kevan M. Cajka, Legal Representative

(73) Assignee: Oddzon, Inc., Pawtucket, RI (US)

( * ) Notice: Subject to any disclaimer, the term of this patent is extended or adjusted under 35 U.S.C. 154(b) by 0 days.

(21) Appl. No.: 09/576,152

(22) Filed: May 22, 2000

(51) Int. Cl.[7] ..... B01F 3/04
(52) U.S. Cl. ..... 261/30; 261/84; 446/15
(58) Field of Search ..... 261/30, 84, 89, 261/91; 446/15; D21/401

(56) References Cited

U.S. PATENT DOCUMENTS

| | | | | |
|---|---|---|---|---|
| D. 304,466 | | 11/1989 | Brown | D21/61 |
| 2,736,988 | | 3/1956 | Fisher | 46/7 |
| 2,987,847 | | 6/1961 | Jones | 46/7 |
| 3,064,387 | | 11/1962 | Campbell | 46/7 |
| 3,100,947 | | 8/1963 | Hellman | 46/8 |
| 3,295,248 | * | 1/1967 | Knerr et al. | 446/15 |
| 3,523,908 | * | 8/1970 | Levy | 261/84 |
| 3,736,694 | | 6/1973 | Lebensfeld | 46/7 |
| 3,925,923 | | 12/1975 | LaFata et al. | 46/7 |
| 3,950,887 | | 4/1976 | Kort | 46/6 |
| 3,968,262 | | 7/1976 | Hodska | 426/134 |
| 4,016,673 | | 4/1977 | Constance | 46/6 |
| 4,044,496 | | 8/1977 | Jernstrom | 46/7 |
| 4,257,185 | | 3/1981 | Tomson | 46/6 |
| 4,299,049 | | 11/1981 | Pimentel et al. | 46/8 |
| 4,447,982 | | 5/1984 | Gushea | 46/8 |
| 4,481,731 | | 11/1984 | LaFata et al. | 446/15 |
| 4,556,392 | | 12/1985 | Chang | 446/16 |
| 4,576,582 | | 3/1986 | Panzarella | 446/16 |
| 4,700,965 | | 10/1987 | Kinberg | 280/289 D |
| 4,764,141 | | 8/1988 | D'Andrade | 446/16 |
| 4,775,348 | | 10/1988 | Collins | 446/16 |
| 4,840,597 | | 6/1989 | Perez | 446/16 |
| 5,078,636 | | 1/1992 | Clarke et al. | 446/15 |

(List continued on next page.)

FOREIGN PATENT DOCUMENTS 2 186 199 8/1987 (GB) .

OTHER PUBLICATIONS

OddzOn/Cap Toys, Inc. instruction sheets for Bubba Billions, 1997, 3 pages.

Cap Toys, Inc. instruction sheets for Big Bubba, 1996, 2 pages.

Pending U.S. Patent Application, including drawings entitled "Bubble Maker Toy", U.S. application No. 09/183,815 filed Oct. 30, 1998, inventors G. Peter Albert Jr., Ronald Rich, Donald A. Marini, Bill James Cajka, which describes prior art Bubba Billions product sold more than one year prior to May 22, 2000.

*Primary Examiner*—C. Scott Bushey
(74) *Attorney, Agent, or Firm*—Marshall, Gerstein, & Borun

(57) ABSTRACT

A bubble-blowing apparatus that may simultaneously produce a plurality of bubble streams from liquid bubble solution is provided with a housing, a rotatable fan associated with the housing, an electric motor operatively coupled to rotatably drive the fan, a battery power source coupled to provide electric power to the motor, an airflow-directing member coupled to the housing that causes air blown by rotation of the fan to be directed predominantly to a peripheral area, and a plurality of bubble-forming tubes operatively coupled to the airflow-directing member at a plurality of points in the peripheral area. Each of the bubble-forming tubes is capable of generating a stream of bubbles and may include a hollow central portion, a base portion, and an end portion that is spaced from the base portion by a distance in a direction parallel to the central diameters of the bubble-forming tubes.

19 Claims, 4 Drawing Sheets

U.S. PATENT DOCUMENTS

| | | | |
|---|---|---|---|
| 5,156,564 | 10/1992 | Hasegawa | 446/15 |
| 5,181,875 | 1/1993 | Hasegawa | 446/15 |
| 5,322,464 | 6/1994 | Sanford | 446/15 |
| 5,366,402 | 11/1994 | Rudell et al. | 446/16 |
| 5,395,274 | 3/1995 | Myers | 446/16 |
| 5,462,469 | 10/1995 | Lei | 446/15 |
| 5,495,876 | 3/1996 | Schramm | 141/98 |
| 5,498,191 | 3/1996 | DeMars | 446/15 |
| 5,653,620 | 8/1997 | Lin | 446/15 |
| 5,879,218 * | 3/1999 | Tao | 446/15 |
| 6,024,623 | 2/2000 | Menow | 446/15 |
| 6,102,764 * | 8/2000 | Thai | 446/15 |
| 6,139,391 * | 10/2000 | Thai et al. | 446/15 |
| 6,149,486 * | 11/2000 | Thai | 446/15 |
| 6,200,184 * | 3/2001 | Rich et al. | 446/15 |

* cited by examiner

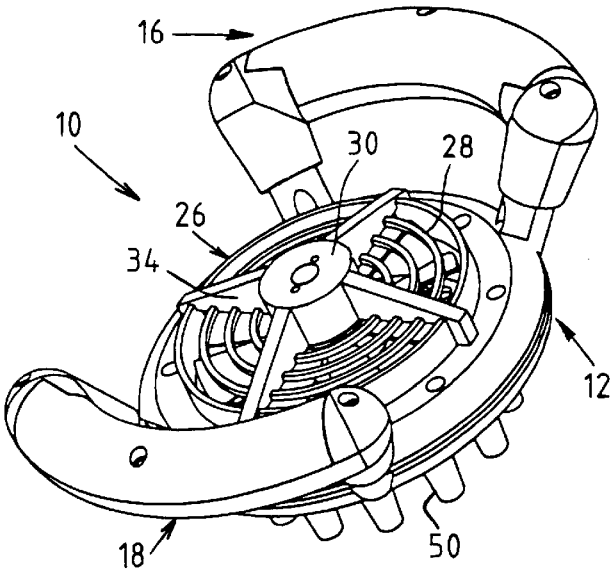
FIG. 1
FIG. 2
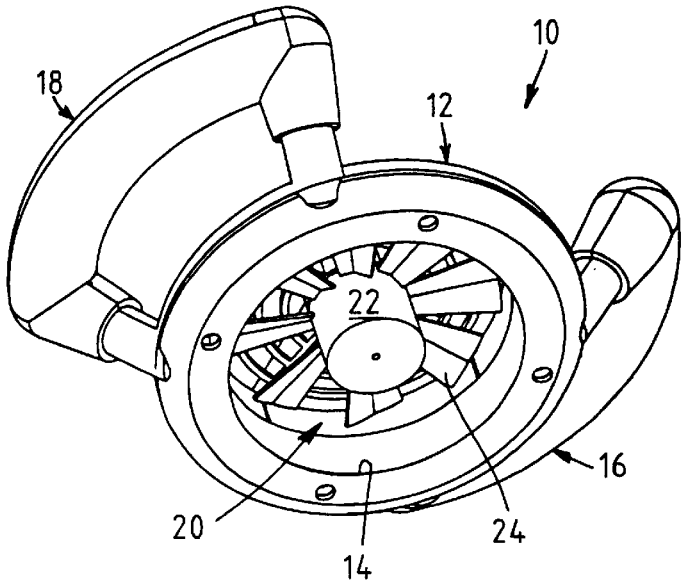
FIG. 3
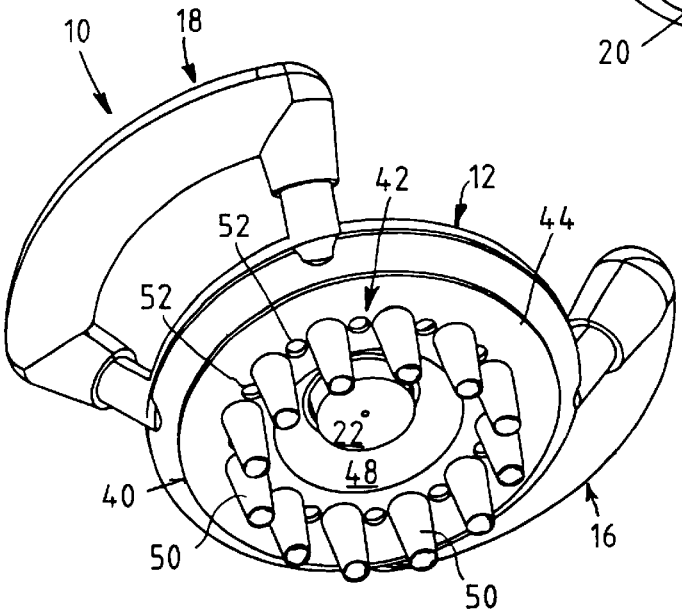

APPARATUS FOR BLOWING STREAMS OF BUBBLES

BACKGROUND OF THE INVENTION

The invention is directed to an apparatus that is capable of simultaneously blowing a plurality of streams of bubbles from liquid bubble solution.

Various apparatus for generating bubbles from liquid bubble solution have been described in prior patents and commercially marketed. For example, a bubble-generating apparatus, the subject of U.S. Pat. No. 6,200,184, that was commercially marketed under the trademark "Bubba Billions" more than one year prior to the filing of this patent was provided with a housing having a central aperture, a handle attached to the housing, a rotatable fan disposed in the central aperture of the housing, an electric motor coupled to drive the fan, a battery power source that provided power to the motor and a bubble-generating structure that was attachable to the housing. The bubble-generating structure included six generally circular bubble-wand structures positioned over the central opening of the housing so that when the fan was rotating, air would be simultaneously blown through all six bubble-wand structures to generate six separate streams of bubbles.

U.S. Pat. No. 5,879,218 to Tao discloses a bubble-making apparatus for generating a connected chain of bubbles, as shown in FIGS. 4 and 5 of the Tao patent. The bubble-making apparatus of the Tao patent is in the form of a gun and is provided with an electric motor, a source of battery power, a rotatable fan driven by the motor, and two separate internal airflow conduits through which airflow generated by the fan passes. One of the airflow conduits is disposed directly above the other airflow conduit. Air passing through the upper airflow conduit is used to generate a connected chain of bubbles, and air passing through the lower airflow conduit is used to generate a stream of air below the connected chain of bubbles. The Tao patent states that the connected chain of bubbles is supported by the stream of air generated by the lower airflow conduit.

SUMMARY OF THE INVENTION

The invention is directed to a bubble-blowing apparatus that may simultaneously produce a plurality of bubble streams from liquid bubble solution. The bubble-blowing apparatus may be provided with a housing, a rotatable fan associated with the housing, an electric motor operatively coupled to rotatably drive the fan, a battery power source coupled to provide electric power to the motor, an airflow-directing member coupled to the housing that causes air blown by rotation of the fan to be directed predominantly to a peripheral area, and a plurality of bubble-forming tubes operatively coupled to the airflow-directing member at a plurality of points in the peripheral area. Each of the bubble-forming tubes is capable of generating a stream of bubbles and may include a hollow central portion, a base portion, and an end portion that is spaced from the base portion by a distance in a direction parallel to the central diameters of the bubble-forming tubes.

The bubble-blowing apparatus may also include a plurality of air passageways located in the peripheral area, each of the air passageways generating a stream of air by causing air blown by the fan to be directed from an interior portion of the housing to outside of the housing. A plurality of internal members may be disposed in the hollow central portion of each of the bubble-forming tubes so as to form a plurality of bubble-solution-holding cavities within the hollow central of each of the bubble-forming tubes.

Each of the bubble-forming tubes may be conical in shape, with the base portion of each of the bubble-forming tubes having an inner diameter that is greater than the inner diameter of the end portion of each of the bubble-forming tubes, and each of the internal members may have a height that varies in a direction parallel to the central diameters of the bubble-forming tubes.

The fan may have a central hub with a hollow interior portion and a plurality of fan blades attached to the central hub, and the motor may be disposed in the hollow interior portion of the central hub. The bubble-blowing apparatus may be provided with one or more handles, the power source may comprise a plurality of batteries, and the batteries may be located in one or more hollow interior portions of the handles.

The features and advantages of the present invention will be apparent to those of ordinary skill in the art in view of the detailed description of the preferred embodiment, which is made with reference to the drawings, a brief description of which is provided below.

BRIEF DESCRIPTION OF THE DRAWINGS

FIG. 1 is a first perspective view of an embodiment of a bubble-blowing apparatus in accordance with the invention;

FIG. 2 is a perspective view of the bubble-blowing apparatus of FIG. 1 with a portion of the apparatus not shown;

FIG. 3 is a second perspective view of the bubble-blowing apparatus of FIG. 1;

DETAILED DESCRIPTION OF VARIOUS EMBODIMENTS

Figure 4:
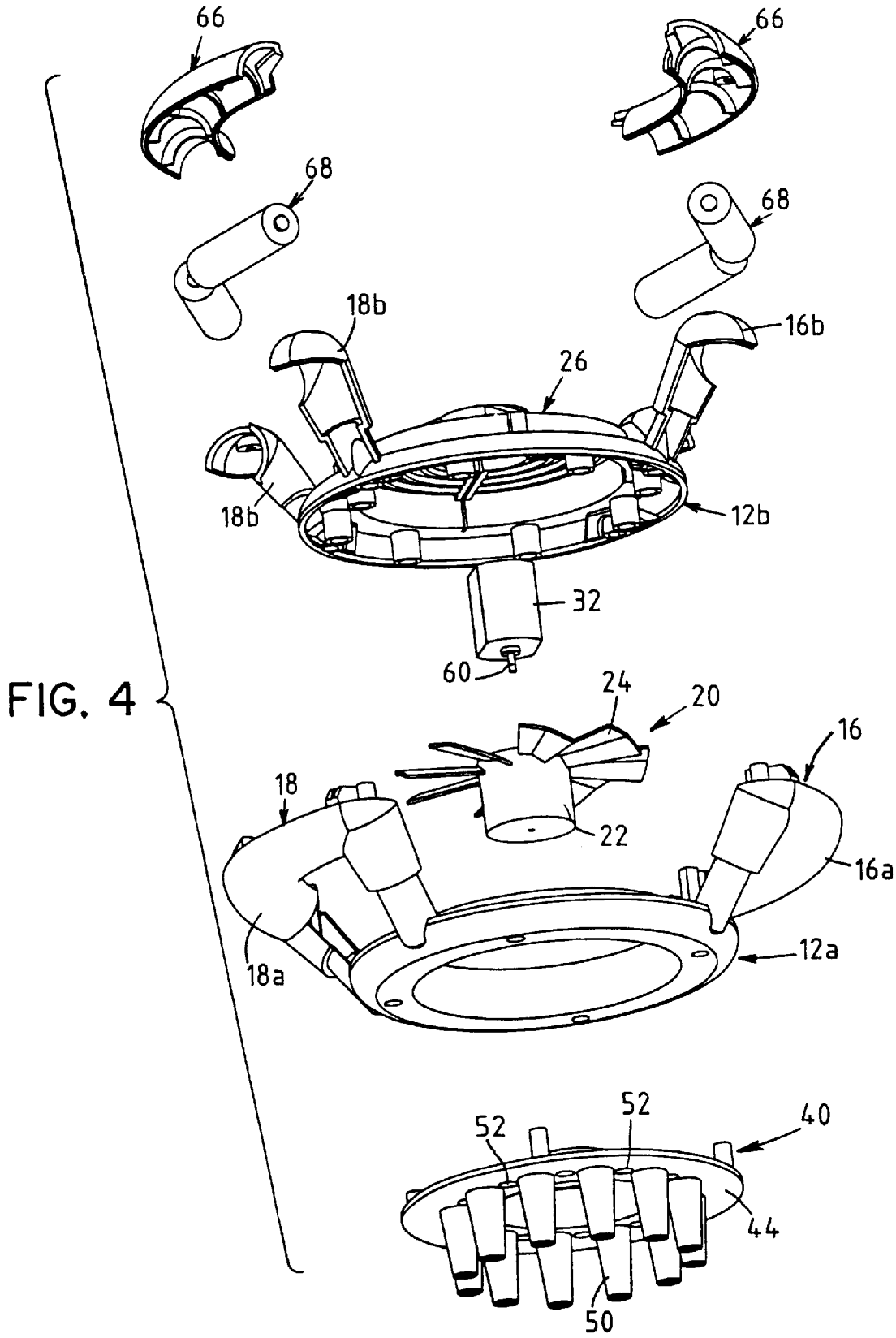
FIG. 4 is an exploded perspective view of the bubble-blowing apparatus of FIG. 1.

FIGS. 1–3 illustrate one embodiment of a bubble-blowing apparatus 10 in accordance with the invention that may be used to simultaneously generate multiple streams of bubbles from liquid bubble solution. Referring to FIGS. 1–3, the bubble-blowing apparatus 10 may be provided with a generally circular housing 12 having a circular central aperture 14 disposed therein. The housing 12 may be composed of plastic, for example. The apparatus 10 may be provided with a first handle 16 connected to one side of the housing 12 and a second handle 18 connected to an opposite side of the housing 12 so that each of the handles 16, 18 may be held in a respective hand of a user.

As shown in FIG. 2, a rotatable fan 20 may be disposed in the central aperture 14 in the housing 12. The rotatable fan 20 may be composed of a generally cylindrical central hub 22 and a plurality of fan blades 24 connected to the central hub 22. The central hub 22 and the fan blades 24 could comprise a single unitary construction composed of plastic, for example. Alternatively, the central hub 22 and/or the fan blades 24 could be composed of a foam material to prevent injury due to contact between the user's fingers, for example, and the rotating fan blades 24.

As shown in FIG. 1, the apparatus 10 may include a housing section 26 provided on one side of the housing 12 over the central aperture 14 of the housing 12 to cover the fan 20. The housing section 26 could be provided to include a plurality of relatively rigid, arcuate ribs 28 spaced closely enough together to prevent, for example, the fingers of a child from passing through them. The housing section 26 could be provided with a mounting structure 30, such as a cylindrically shaped structure, to support an electric motor 32 (see FIGS. 4 and 6) for rotatably driving the fan 20.

The housing section 26 may also include a plurality of support members 34 (that may have hollow interior portions) that extend from the mounting structure 30 to an outer portion of the housing section 26. The ribs 28, the mounting structure 30, and the support members 34 of the housing section 26 may be integrally formed with each other, such as by injection molding.

Figure 5:
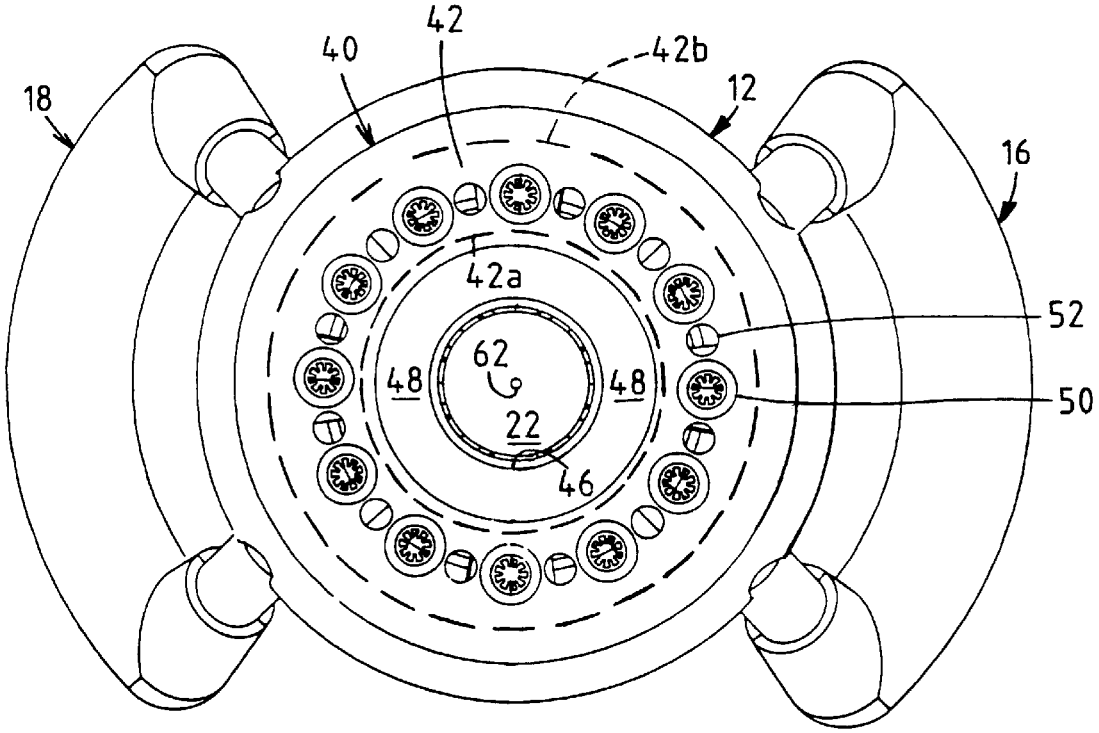
FIG. 5 is a bottom view of the bubble-blowing apparatus of FIG. 1.

As shown in FIGS. 3 and 4, the apparatus 10 may be provided with an airflow-directing member 40 that may be attached to the side of the housing 12 that is opposite that to which the housing section 26 is attached. The airflow-directing member 40, which may be circular in shape, may be provided with a peripheral area 42 that coincides with an inner portion of an annular face 44 of the airflow-directing member 40. As shown in FIG. 5, the peripheral area 42 may be circular in shape, and may correspond to an area defined by an inner circular dotted line 42*a* and an outer circular dotted line 42*b*.

Figure 6:
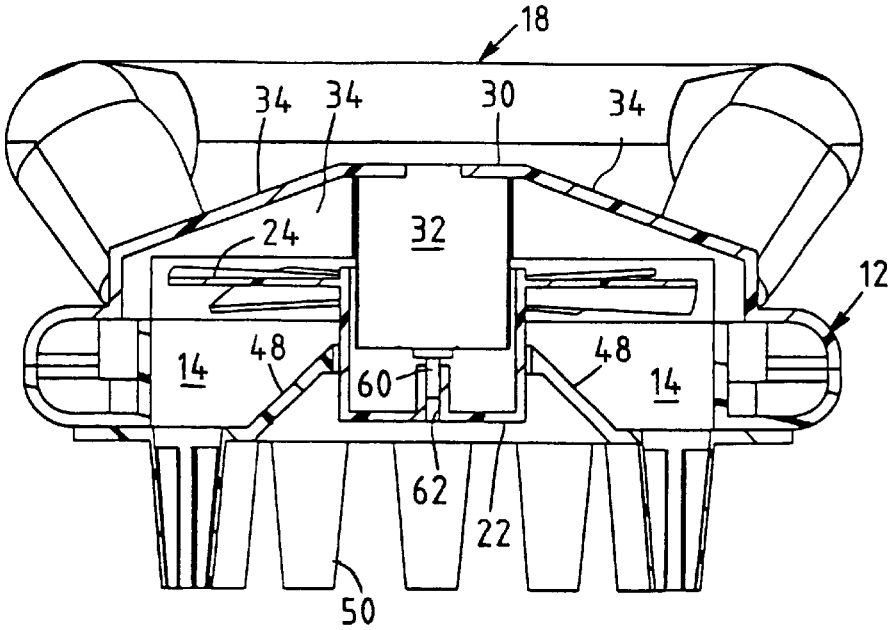
FIG. 6 is a side view of the bubble-blowing apparatus of FIG. 1 with portions shown in cross section.

As shown in FIGS. 5 and 6, the airflow-directing member 40 may have a central aperture 46, and a cone-shaped portion 48 may join the central aperture 46 to an inner side of the peripheral area 42. The central hub 22 of the fan 20 may pass at least partially through the central aperture 46 of the airflow-directing member 40.

Alternatively, the airflow-directing member 40 may have no central aperture 46. In that case, the airflow-directing member 40 may be provided with a central cup-shaped cover portion (not shown) that generally corresponds to the shape of the central hub 22 and that covers the central hub 22, which cover portion may prevent foaming of bubble solution that otherwise might occur if bubble solution spilled into the space formed between the rotating central hub 22 and the central aperture 46.

A plurality of bubble-forming tubes 50 may be connected to or integrally formed with the airflow-directing member 40 in the peripheral area 42. The bubble-forming tubes 50 may be conical in shape, they may be circular in cross section, and they may be at least about one centimeter in length, or about two centimeters in length. A plurality of air passageways 52, which may be provided in the form of holes in the surface 44 of the airflow-directing member 40, may be provided in the peripheral area 42. Each of the holes 52 may be located between an adjacent pair of the bubble-forming tubes 50. Although the holes 52 are shown to be circular, they may be of other shapes, such as crescents, for styling purposes.

Referring to FIG. 6, the motor 32 may be provided with an outwardly extending rotatable drive shaft 60 that may be disposed in a bore 62 formed in the central hub 22 and that is fixed to the central hub 22, such as by an interference fit with the bore 62, so that rotation of the drive shaft 60 will induce rotation of the central hub 22 of the fan 20.

Referring to FIG. 4, which is an exploded perspective view, the housing 12 of the bubble-blowing apparatus 10 may be provided in multiple sections, such as a first housing section 12*a* and a second housing section 12*b*, which may be connected together in any fashion, such as by being screwed or snap-fit together. The handles 16, 18 may also be provided in multiple sections, such as handle sections 16*a*, 16*b*, 18*a*, 18*b*. One or more battery compartments may be disposed in hollow portions of the handles 16, 18, and a removable battery cover 66 for each battery compartment may be provided and shaped to form part of the handles 16, 18. One or more batteries 68 may be provided in each of the battery compartments. An actuator switch (not shown) for controlling the supply of electric current from the batteries 68 to the motor 32, such as a momentary contact switch, may also be provided. The actuator switch may be provided on or adjacent to one of the handles 16, 18.

Figure 8:
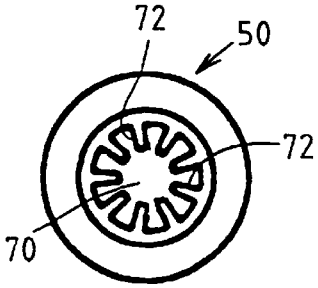
FIG. 8 is a bottom view of one embodiment of one of the bubble-forming tubes of the bubble-blowing apparatus.
Figure 9:
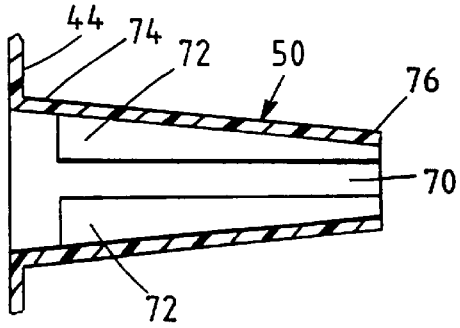
FIG. 9 is a cross-sectional side view of one embodiment of the bubble-forming tubes of the bubble-blowing apparatus.

FIG. 8 is an enlarged bottom view of one possible embodiment of the bubble-forming tubes 50, and FIG. 9 is a cross-sectional view of one possible embodiment of the bubble-forming tubes 50. Referring to FIGS. 8 and 9, each of the bubble-forming tubes 50 has a hollow central portion 70, and a plurality of internal members 72 may be provided in the hollow central portion 70. The internal members 72 may be provided in the form of substantially planar members having a triangular shape. Each of the bubble-forming tubes 50 has a base portion 74 disposed at or adjacent the surface 44 of the airflow-directing member 40 and an end portion 76 spaced from the base portion 74 in a direction parallel to the longitudinal central axis of each of the tubes 50. As shown in FIG. 9, each of the internal members 72 may be provided with a height that varies along the length of the tube 50, with the greatest height occurring generally adjacent the base portion 74 and the smallest height occurring at the end portion 76. The length of each of the internal members 72 may be almost equal to the length of each of the bubble-forming tubes 50, or equal to at least about 75% of the length of each of the bubble-forming tubes 50.

The internal members 72 may be spaced about the central hollow portion 70 so as to form a plurality of cavities which hold bubble solution when the ends of the tubes 50 are dipped into bubble solution and removed from the solution. Due to the cavities, the bubble-forming tubes 50 may hold an increased amount of bubble solution therein. For example, bubble-forming tubes 50 with the internal members 72 may hold about two or three times as much bubble solution as those without the internal members 72. In the case of tubes 50 with the internal members 72, the bubble solution would be retained within the tubes 50 to a depth about two or three times the depth to which bubble solution would be retained in tubes 50 without the internal members 72. When more bubble solution is retained in the bubble-forming tubes 50, the bubble-blowing apparatus 10 will generate bubble streams for a longer period of time.

Figure 7:
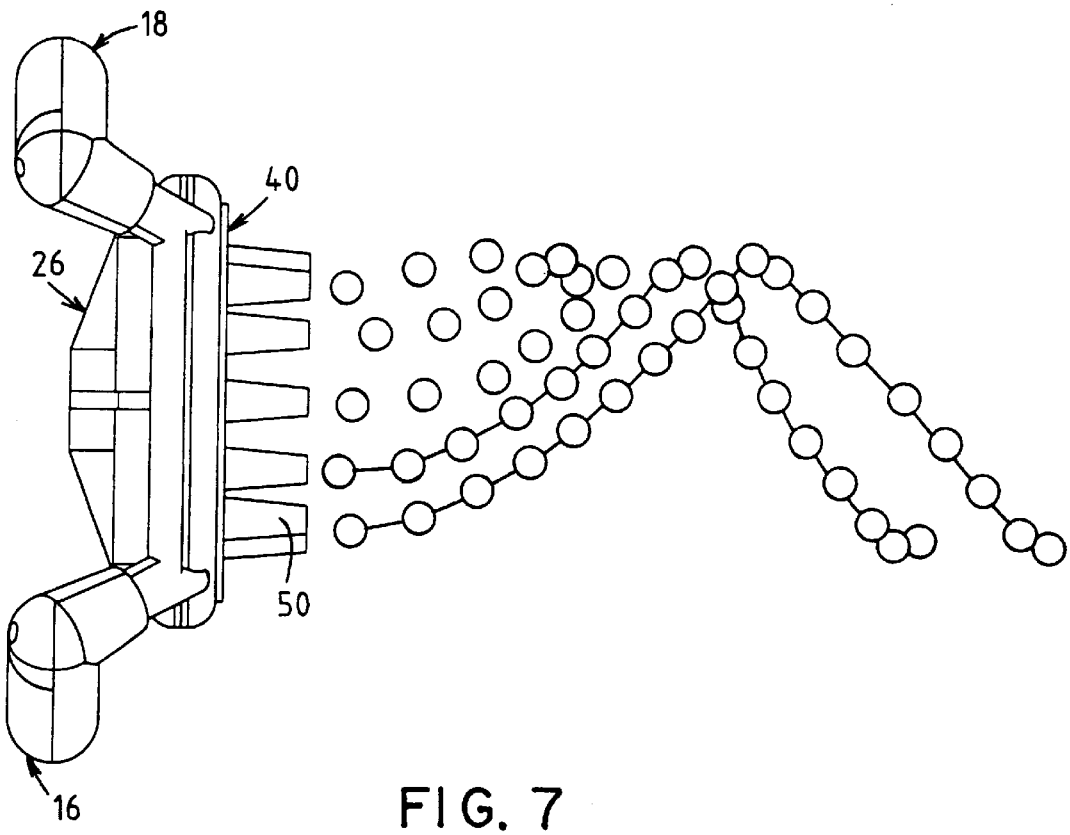
FIG. 7 is a side view of the bubble-blowing apparatus of FIG. 1 showing its operation.

In operation, before turning on the motor 32, the ends of the bubble-forming tubes 50 may be dipped into a relatively large pan of bubble solution and removed, which will cause a volume of bubble solution to be retained in the hollow cavity 70 disposed in each of the bubble-forming tubes 50. When the motor 32 is then turned on, the fan 20 will rotate and cause air to flow through the spaces between the arcuate rib members 28 formed in the housing section 26, through the central aperture 14 in the housing 12, through each of the bubble-forming tubes 50 and through each of the air passageways 52. As shown in FIG. 7, each of the bubble-forming tubes 50 will generate a stream of bubbles, and each of the bubble streams may have a helical or spiral shape.

Except for a portion of air that may pass through the annular space between the central hub 22 and the circular aperture 46 in the airflow-directing member 40, the airflow-directing member 40 directs all of the air that enters the central aperture 14 of the housing 12 to either the tubes 50 or the passageways 52 that are situated in the ring-shaped peripheral area 42. The airflow-directing member 40 may cause air blown by the fan 20 to be directed substantially exclusively to the peripheral area 42, or predominantly to the peripheral area 42.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A bubble-blowing apparatus that may simultaneously produce a plurality of bubble streams from liquid bubble solution, said bubble-blowing apparatus comprising:

a housing having a central aperture formed therein;

a first handle connected to said housing at a first connection point on a first side of said housing, said first handle being shaped to allow said first handle to be gripped by a first hand of a user;

a second handle connected to said housing at a second connection point on a second side of said housing opposite said first side of said housing, said second handle being shaped to allow said second handle to be gripped by a second hand of the user;

a rotatable fan disposed in said central aperture of said housing;

an electric motor operatively coupled to rotatably drive said fan;

a battery power source coupled to provide electric power to said electric motor;

an airflow-directing member coupled to said housing, said airflow-directing member having a circular periphery and causing air blown by rotation of said fan to be directed substantially exclusively to a ring-shaped area;

a plurality of bubble-forming tubes operatively coupled to said airflow-directing member at a plurality of points in said ring-shaped area, each of said bubble-forming tubes capable of generating a stream of bubbles, each of said bubble-forming tubes having a central diameter and comprising:

a hollow central portion;

a base portion;

an end portion that is spaced from said base portion by a distance in a direction parallel to said central diameters of said bubble-forming tubes, said distance being at least about one centimeter; and a plurality of internal members disposed in said hollow central portion of each of said bubble-forming tubes, said internal members being disposed so as to form a plurality of bubble-solution-holding cavities within said hollow central of each of said bubble-forming tubes, said cavities holding bubble solution when said bubble-forming tubes are dipped into bubble solution and removed from said bubble solution; and a plurality of air passageways located in said ring-shaped area, each of said air passageways generating a stream of air by causing air blown by said fan to be directed from an interior portion of said housing to outside of said housing, said streams of air generated by said air passageways affecting movement of bubbles generated by said bubble-forming tubes, each of said air passageways being located between a pair of said bubble-forming tubes, said streams of air causing said bubbles to be propelled away from said bubble-forming tubes after said bubbles are formed.

2. An apparatus as defined in claim 1 wherein each of said bubble-forming tubes is conical in shape, wherein said base portion of each of said bubble-forming tubes has an inner diameter, wherein said end portion of each of said bubble-forming tubes has an inner diameter, wherein said inner diameter of said base portion of each of said bubble-forming tubes is larger than said inner diameter of said end portion of each of said bubble-forming tubes, and wherein each of said internal members has a height that varies in a direction parallel to said central diameters of said bubble-forming tubes.

3. An apparatus as defined in claim 1 wherein each of said air passageways comprises a hole in said airflow-directing member.

4. An apparatus as defined in claim 1 wherein said fan comprises a central hub having a hollow interior portion and a plurality of fan blades attached to said central hub and wherein said electric motor is disposed in said hollow interior portion of said central hub.

5. An apparatus as defined in claim 1 wherein said battery power source comprises a battery, wherein one of said handles has a hollow interior portion, and wherein said battery is disposed in said hollow interior portion of said one handle.

6. An apparatus as defined in claim 1 wherein said battery power source comprises a first battery and a second battery, wherein said first handle has a hollow interior portion, wherein said second handle has a hollow interior portion, wherein said first battery is disposed in said hollow interior portion of said first handle, and wherein said second battery is disposed in said hollow interior portion of said second handle.

7. An apparatus as defined in claim 1 wherein said base portion of each of said bubble-forming tubes is connected to said airflow-directing member and wherein said end portion of each of said bubble-forming tubes is spaced from said airflow-directing member by at least about one centimeter.

8. An apparatus as defined in claim 1 wherein said airflow-directing member has a central aperture formed therein, wherein said fan has a central hub, and wherein said central hub extends into said central aperture of said airflow-directing member.

9. A bubble-blowing apparatus that may simultaneously produce a plurality of bubble streams from liquid bubble solution, said bubble-blowing apparatus comprising:

a housing having a central aperture formed therein;

a rotatable fan disposed in said central aperture of said housing;

an electric motor operatively coupled to rotatably drive said fan;

a battery power source coupled to provide electric power to said electric motor;

an airflow-directing member coupled to said housing, said airflow-directing member having an outer periphery and causing air blown by rotation of said fan to be directed predominantly to a peripheral area;

a plurality of bubble-forming tubes operatively coupled to said airflow-directing member at a plurality of points in said peripheral area, each of said bubble-forming tubes capable of generating a stream of bubbles, each of said bubble-forming tubes having a central diameter and comprising:

a hollow central portion;

a base portion; and an end portion that is spaced from said base portion by a distance in a direction parallel to said central diameters of said bubble-forming tubes; and a plurality of air passageways located in said peripheral area, each of said air passageways generating a stream of air by causing air blown by said fan to be directed from an interior portion of said housing to outside of said housing.

10. An apparatus as defined in claim 9 additionally comprising a plurality of internal members disposed in said hollow central portion of each of said bubble-forming tubes, said internal members being disposed so as to form a plurality of bubble-solution-holding cavities within said hollow central of each of said bubble-forming tubes, said cavities holding bubble solution when said bubble-forming tubes are dipped into bubble solution and removed from said bubble solution.

11. An apparatus as defined in claim 9 additionally comprising a plurality of internal members disposed in said hollow central portion of each of said bubble-forming tubes, said internal members being disposed so as to form a plurality of bubble-solution-holding cavities within said hollow central of each of said bubble-forming tubes, said cavities holding bubble solution when said bubble-forming tubes are dipped into bubble solution and removed from said bubble solution, each of said internal members having a length of at least about one centimeter.

12. An apparatus as defined in claim 9 additionally comprising a plurality of internal members disposed in said hollow central portion of each of said bubble-forming tubes, said internal members being disposed so as to form a plurality of bubble-solution-holding cavities within said hollow central of each of said bubble-forming tubes, said cavities holding bubble solution when said bubble-forming tubes are dipped into bubble solution and removed from said bubble solution, each of said internal members having a height that varies along a length of one of said bubble-blowing tubes.

13. An apparatus as defined in claim 9 wherein each of said air passageways is located between a pair of said bubble-forming tubes.

14. An apparatus as defined in claim 9 wherein said peripheral area is a ring-shaped area.

15. An apparatus as defined in claim 9 wherein each of said tubes has a length of at least about one centimeter.

16. A bubble-blowing apparatus that may simultaneously produce a plurality of bubble streams from liquid bubble solution, said bubble-blowing apparatus comprising:

a housing;

a rotatable fan associated with said housing;

an electric motor operatively coupled to rotatably drive said fan;

a battery power source coupled to provide electric power to said electric motor;

an airflow-directing member coupled to said housing, said airflow-directing member causing air blown by rotation of said fan to be directed predominantly to a peripheral area; and a plurality of bubble-forming tubes operatively coupled to said airflow-directing member at a plurality of points in said peripheral area, each of said bubble-forming tubes capable of generating a stream of bubbles, each of said bubble-forming tubes having a central diameter and comprising:

a hollow central portion;

a base portion; and an end portion that is spaced from said base portion by a distance in a direction parallel to said central diameters of said bubble-forming tubes.

17. An apparatus as defined in claim 16 additionally comprising a plurality of air passageways located in said peripheral area, each of said air passageways generating a stream of air by causing air blown by said fan to be directed from an interior portion of said housing to outside of said housing.

18. An apparatus as defined in claim 16 additionally comprising a plurality of internal members disposed in said hollow central portion of each of said bubble-forming tubes, said internal members being disposed so as to form a plurality of bubble-solution-holding cavities within said hollow central of each of said bubble-forming tubes, said cavities holding bubble solution when said bubble-forming tubes are dipped into bubble solution and removed from said bubble solution.

19. An apparatus as defined in claim 16 additionally comprising a plurality of internal members disposed in said hollow central portion of each of said bubble-forming tubes, said internal members being disposed so as to form a plurality of bubble-solution-holding cavities within said hollow central of each of said bubble-forming tubes, said cavities holding bubble solution when said bubble-forming tubes are dipped into bubble solution and removed from said bubble solution, each of said internal members having a height that varies along a length of one of said bubble-blowing tubes.

* * * * *